US009945270B2

(12) United States Patent
Ahmed et al.

(10) Patent No.: US 9,945,270 B2
(45) Date of Patent: Apr. 17, 2018

(54) ROCKER SHAFT WITH DE-AERATION OIL GALLERY SEGMENT

(71) Applicant: Schaeffler Technologies AG & Co. KG, Herzogenaurach (DE)

(72) Inventors: Faheem Ahmed, Troy, MI (US); Colin Foster, Belle River (CA); David Chandler, Windsor (CA); John Whitton, Milwaukee, WI (US); Debora Manther, Royal Oak, MI (US); Pradeep Mohan Mohan Das, Troy, MI (US); Sumukha Nagaraj, Dearborn, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 84 days.

(21) Appl. No.: 15/217,325

(22) Filed: Jul. 22, 2016

(65) Prior Publication Data

US 2017/0022848 A1 Jan. 26, 2017

Related U.S. Application Data

(60) Provisional application No. 62/195,835, filed on Jul. 23, 2015.

(51) Int. Cl.

| | |
|---|---|
| ***F01M 11/02*** | (2006.01) |
| ***F01L 1/24*** | (2006.01) |
| ***F01L 1/18*** | (2006.01) |
| ***F01L 13/00*** | (2006.01) |
| *F01L 1/46* | (2006.01) |

(52) U.S. Cl.
CPC ..... *F01L 1/24* (2013.01); *F01L 1/18* (2013.01); *F01L 1/181* (2013.01); *F01L 13/0005* (2013.01); *F01L 1/2416* (2013.01); *F01L 1/46* (2013.01)

(58) Field of Classification Search
CPC ..... F01L 1/181; F01L 1/2416; F01L 1/46
USPC ..... 123/90.36, 90.46
See application file for complete search history.

(56) References Cited

U.S. PATENT DOCUMENTS

| | | | | |
|---|---|---|---|---|
| 5,125,373 A * | 6/1992 | Yamada | F01L 1/18 | 123/196 M |
| 5,592,907 A | 1/1997 | Hasebe et al. | | |
| 6,598,578 B2 | 7/2003 | Takahashi et al. | | |
| 6,810,846 B2 * | 11/2004 | Murata | F01L 1/267 | 123/196 M |

(Continued)

OTHER PUBLICATIONS

U.S. Appl. No. 15/175,654, filed Jun. 7, 2016. (Unpublished).

*Primary Examiner* — Jorge Leon, Jr.
(74) *Attorney, Agent, or Firm* — Volpe and Koenig, P.C.

(57) ABSTRACT

A hollow rocker shaft including a central opening defined by a radially inner surface and a separator secured in the central opening of the rocker shaft is provided. A radially outer surface of the separator engages the radially inner surface of the rocker shaft via a press-fit. The separator divides the central opening of the rocker shaft into (1) a first chamber extending between a first chamber axial end and the separator, and (2) a second chamber extending between a second chamber axial end and the separator. The separator includes an orifice defined between the first chamber and the second chamber that provides fluid connection between the first chamber and the second chamber.

18 Claims, 4 Drawing Sheets

(56) References Cited

U.S. PATENT DOCUMENTS

| | | | | |
|---|---|---|---|---|
| 2008/0302322 | A1 | 12/2008 | Edelmayer et al. | |
| 2010/0170472 | A1* | 7/2010 | Yang | F01L 1/08 123/321 |

* cited by examiner

ROCKER SHAFT WITH DE-AERATION OIL GALLERY SEGMENT

INCORPORATION BY REFERENCE

The following document is incorporated herein by reference as if fully set forth: U.S. Provisional Patent Application No. 62/195,835, filed Jul. 23, 2015.

FIELD OF INVENTION

The present invention relates to a switchable valve train, and more particularly relates to a rocker shaft for a switchable valve train.

BACKGROUND

Multiple types of switchable valve train systems including rocker arms arranged on rocker shafts are known. One type of switchable valve train system includes rocker arms with a hydraulic lash adjuster and a locking assembly arranged on opposite sides of the rocker arm. One type of known rocker shaft includes a hollow center for directing hydraulic fluid from a feed port to the hydraulic lash adjuster and the locking assembly of an associated rocker arm.

One known arrangement of a switchable valve train is shown in FIG. 1, which is from U.S. Pub. 2008/0302322. As shown in FIG. 1, the switchable valve train assembly 100 includes a rocker shaft 101 having a plurality of intake ports 102. A plurality of rocker arm assemblies 110 are provided along the rocker shaft 101 that include a camshaft end 106 and a valve end 108. The rocker shaft 101 includes a hollow center 104 for directing hydraulic fluid from a hydraulic fluid supply assembly (not shown) to the associated rocker arm assemblies 110. The rocker arm assemblies 110 are selectively controlled to actuate a locking assembly and to supply pressurized hydraulic fluid to the lash adjuster (not shown) associated with each rocker arm assembly 110 based on a supply of hydraulic fluid from the hollow center 104 of the rocker shaft 101. The flow of hydraulic fluid through the rocker shaft 101 can create air bubbles or pockets, which causes hydraulic fluid flow fluctuations and disrupts performance of the rocker arm assemblies.

It would be desirable to provide a rocker shaft that offers a reliable, continuous flow of de-aerated hydraulic fluid from the hydraulic fluid supply assembly to the locking assembly of the rocker arm assembly.

SUMMARY

A switchable valve train assembly including a rocker shaft with an improved internal chamber configuration that reduces air pockets and air bubbles is provided. The switchable valve train assembly includes a supply assembly including a pressurized fluid source for pressurized hydraulic fluid, and a solenoid and a control valve for selectively supplying the hydraulic fluid. A hydraulic lash adjuster feed channel is in fluid connection with the pressurized fluid source, and a switch channel is in fluid connection with the control valve. A hollow rocker shaft includes a central opening defined by a radially inner surface, and a separator is secured in the central opening of the rocker shaft by a radially outer surface of the separator engaging the radially inner surface of the rocker shaft. The separator divides the central opening of the rocker shaft into a (1) first chamber extending between a first chamber axial end and the separator, and (2) a second chamber extending between a second chamber axial end and the separator. The separator includes an orifice defined between the first chamber and the second chamber providing fluid connection between the first chamber and the second chamber. A first chamber end cap is fixed in the rocker shaft and defines the first chamber axial end, and a second chamber end cap is fixed in the rocker shaft and defines the second chamber axial end. The hydraulic lash adjuster feed channel is in fluid communication with the first chamber, and the switch channel is in fluid communication with the second chamber. A rocker arm assembly is arranged on the rocker shaft and includes a hydraulic lash adjuster connected to a first intake port and a locking assembly connected to a second intake port. The first chamber includes a first actuator port in fluid connection with the first intake port for the hydraulic lash adjuster, and the second chamber includes a second actuator port in fluid connection with the second intake port for the locking assembly.

The orifice of the separator provides fluid connection between the first chamber and the second chamber and ensures a continuous flow of hydraulic fluid which helps reduce air pockets and air bubbles in the hydraulic fluid in the second chamber.

In one embodiment, the separator includes a first recess on the radially outer surface that defines a first passage between the first chamber and the first actuator port, and a second recess on the radially outer surface that defines a second passage between the second chamber and the second actuator port.

In another embodiment, more than one separator is provided within the rocker shaft.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
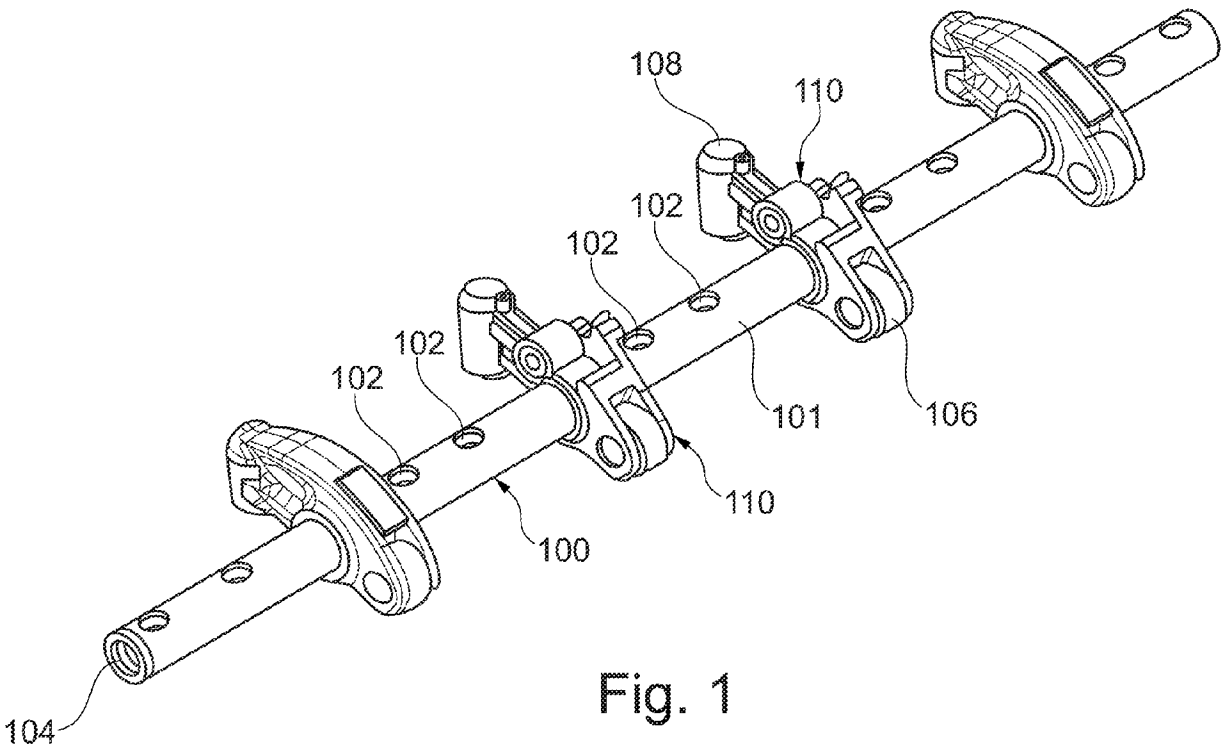
Fig. 1 ( PRIOR ART)
FIG. 1 is a perspective view of a rocker shaft according to the prior art.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
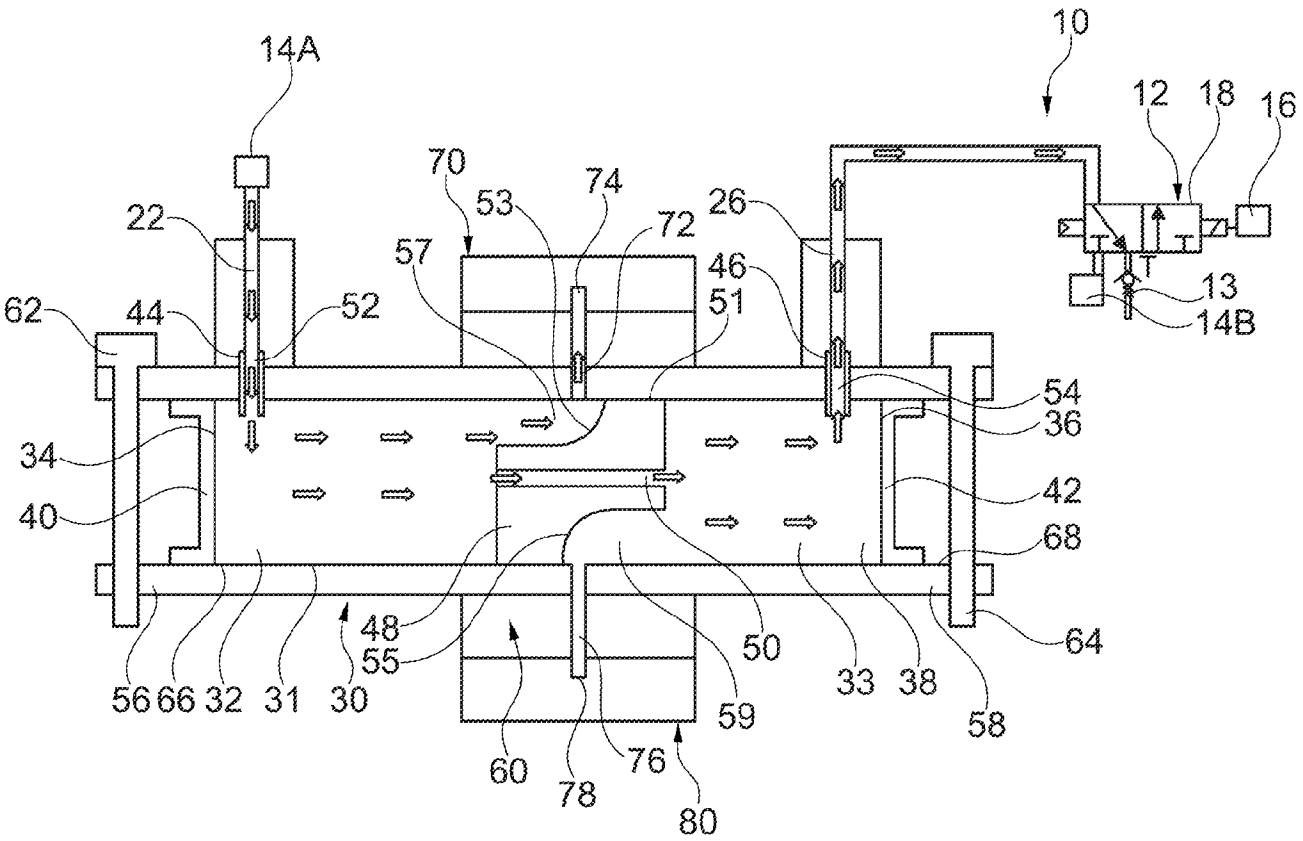
FIG. 2 is a schematic sectional view of a switchable valve train assembly according to an embodiment of the disclosure in a non-actuated state.
Figure 3:
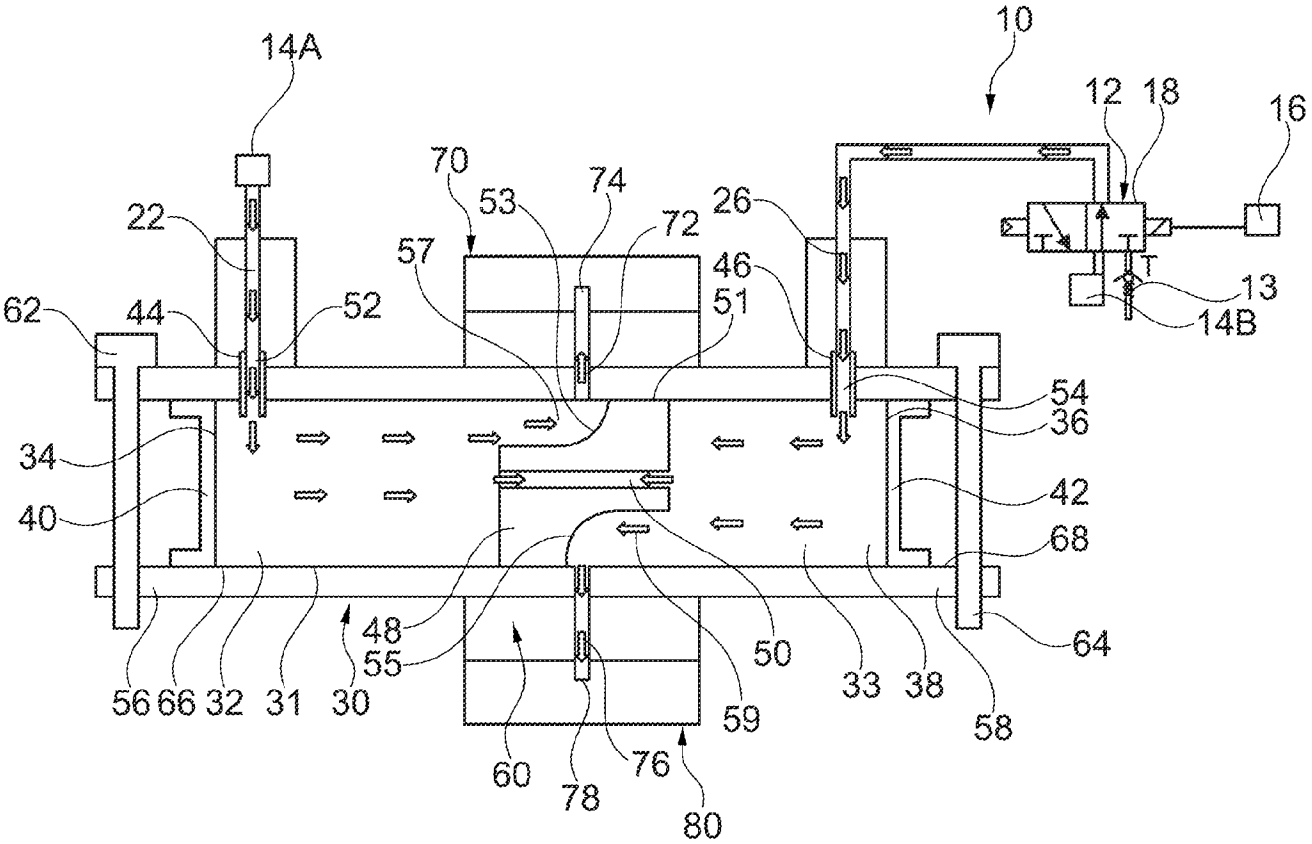
FIG. 3 is a schematic sectional view of the switchable valve train assembly of FIG. 2 in an actuated state.

Referring to FIGS. 2 and 3, a switchable valve train assembly 10 including a supply assembly 12 and a hollow rocker shaft 30 is provided. The supply assembly 12 includes a pressurized fluid source 14A, 14B for pressurized hydraulic fluid, and a solenoid 16 and a control valve 18 for selectively supplying the pressurized hydraulic fluid. A hydraulic lash adjuster feed channel 22 is in fluid connection with the pressurized fluid source 14A, and a switch channel 26 is in fluid connection with the pressurized fluid source 14B or a tank connection (T) via a check valve 13, depending on the position of the control valve 18. The pressurized fluid source 14A, 14B are schematically illustrated as two separate sources in FIGS. 2 and 3, however the pressurized fluid sources 14A, 14B for each of the hydraulic lash adjuster feed channel 22 and the switch channel 26 are provided within the same hydraulic fluid circuit.

The rocker shaft 30 includes a central opening 33 defined by a radially inner surface 31. The rocker shaft 30 can be formed from steel, aluminum, or any other suitable material. A separator 48 is secured in the central opening 33 of the rocker shaft 30 and a radially outer surface 51 of the separator 48 engages the radially inner surface 31 of the rocker shaft 30. In one embodiment, the separator 48 is press-fit within the rocker shaft 30. The separator 48 divides the central opening 33 of the rocker shaft 30 into (1) a first chamber 32 extending between a first chamber axial end 34 of the rocker shaft 30 and the separator 48, and (2) a second chamber 38 extending between a second chamber axial end 36 of the rocker shaft 30 and the separator 48. The separator 48 includes an orifice 50 defined between the first chamber 32 and the second chamber 38 providing fluid connection between the first chamber 32 and the second chamber 38. The separator 48 can be formed from plastic, metal, or any other suitable material. One of ordinary skill in the art would recognize from the present disclosure that the shape of the separator 48 can be varied. Any shape or configuration of the separator 48 can be used as long as the separator 48 provides three main functions: (1) dividing the rocker shaft 30 into the first chamber 32 and the second chamber 38; (2) directing pressurized hydraulic fluid out of the first chamber 32 and the second chamber 38 and towards a rocker arm assembly 60; and (3) providing fluid connection between the first chamber 32 and the second chamber 38, i.e. via the orifice 50.

A first chamber end cap 40 fixed in the rocker shaft 30 defines the first chamber axial end 34, and a second chamber end cap 42 fixed in the rocker shaft 30 defines the second chamber axial end 36. The hydraulic lash adjuster feed channel 22 is in fluid communication with the first chamber 32 and the switch channel 26 is in fluid communication with the second chamber 38. The orifice 50 reduces air pockets and air bubbles in the second chamber 38 in order to improve the function of the switchable valve train assembly 10. The orifice 50 ensures that the second chamber 38 is always filled with hydraulic fluid and immediately available for a switching operation which reduces switching times of the switchable valve train assembly 10.

A first tube 44 extends between the hydraulic lash adjuster feed channel 22 and the first chamber 32. A second tube 46 extends between the switch channel 26 and the second chamber 38. One of ordinary skill in the art would recognize from the present disclosure that alternative channeling arrangements could be used to direct pressurized hydraulic fluid from the supply assembly 12 to the rocker shaft 30 which do not include separately formed sleeves 44, 46.

The rocker arm assembly 60 is arranged on the rocker shaft 30 and includes a hydraulic lash adjuster 70 connected to a first intake port 74 and a locking assembly 80 connected to a second intake port 78. The first chamber 32 includes a first actuator port 72 in fluid connection with the first intake port 74 for the hydraulic lash adjuster 70, and the second chamber 38 includes a second actuator port 76 in fluid connection with the second intake port 78 for the locking assembly 80. The hydraulic lash adjuster 70 and the locking assembly 80 are selectively operated based on the supply of pressurized hydraulic fluid from the supply assembly 12. In one embodiment, the separator 48 includes a first recess 53 on the radially outer surface 51 that defines a first passage 57 between the first chamber 32 and the first actuator port 72, and the separator 48 includes a second recess 55 on the radially outer surface 51 that defines a second passage 59 between the second chamber 38 and the second actuator port 76. As shown in FIGS. 2 and 3, the first recess 53 and the second recess 55 of the separator 48 overlap in a plane extending in a radial direction. Alternatively, the separator could be formed by an angled plate set at an angle to the shaft axis so that no recesses are needed.

In one embodiment, the rocker shaft 30 includes a first axially extending flange 56 at the first chamber axial end 34 and a second axially extending flange 58 at the second chamber axial end 36. A first bolt 62 radially extends through the first axially extending flange 56 and a second bolt 64 radially extends through the second axially extending flange 58. In one embodiment, the first chamber end cap 40 is fixed to the first chamber axial end 34 of the rocker shaft 30 via a press-fit against a radially inner surface 66 of the first axially extending flange 56. The second chamber end cap 42 is also fixed to the second chamber axial end 36 of the rocker shaft 30 via a press-fit against a radially inner surface 68 of the second axially extending flange 58. One of ordinary skill in the art would recognize from the present disclosure that alternative configurations of the end portions of the rocker shaft 30 may be used.

As shown in FIG. 2, the supply assembly 12 is in a non-actuated state for the locking assembly 80 of the rocker arm assembly 60 in which the solenoid 16 is in a first position and the control valve 18 of the supply assembly 12 directed to the switch channel 26 is closed, and the switch channel 26 is connected to the tank connection (T) via the check valve 13. In the non-actuated state, the orifice 50 directs pressurized hydraulic fluid from the first chamber 32 to the second chamber 38, as shown by the arrows in the orifice 50 in FIG. 2 where it can flow back through the switch channel 26 at a pressure set by the check valve 13, which is lower than the locking assembly 80 activation pressure, to the tank (T). This residual hydraulic fluid through the second chamber 38 purges the second chamber 38 of air pockets and air bubbles, and helps keep the second chamber 38 filled with hydraulic fluid for optimal switching times of the switchable valve train assembly 10.

As shown in FIG. 3, the supply assembly 12 is in an actuated state in which the solenoid 16 is in the second, switching state and the control valve 18 of the supply assembly 12 is connected to switching channel 26. In the actuated switching state, pressurized hydraulic fluid is provided to the locking assembly 80 via the second chamber 38, to unlock or deactivate a particular rocker arm. In one embodiment, the first mode of FIG. 2 corresponds to a locked mode in which the rocker arm assembly 60 is locked so that the associated valves of the switchable valve train assembly 10 are opened and closed for active cylinders. In this embodiment, the second mode of FIG. 3 corresponds to an unlocked mode in which the switchable rocker arm assembly 60 is unlocked and therefore the valves of the switchable valve train assembly 10 remain closed, which is used in connection with deactivating certain cylinders. One of ordinary skill in the art would recognize from the present disclosure that the first mode of FIG. 2 could correspond to an unlocked mode, and the second mode of FIG. 3 could correspond to a locked mode. One of ordinary skill in the art would also recognize from the present disclosure that the present arrangement could be used in connection with a cam profile switching strategy.

FIGS. 2 and 3 illustrate a shortened representation of a typical rocker shaft 30 with a single rocker arm 60. Those skilled in the art will recognize that a plurality of rocker arm assemblies 60, such as shown in FIG. 1, would typically be present on the rocker arm shaft, and only a single rocker arm assembly 60 has been illustrated in FIGS. 2 and 3 for the sake of clarity. Additionally, a plurality of separators 48, supply assemblies 12, pressurized fluid sources 14A, 14B, and the associated features and components of these elements could be provided within a single hollow rocker shaft 30. A single rocker shaft including multiple separators is discussed below with respect to FIGS. 4 and 5.

Figure 4:
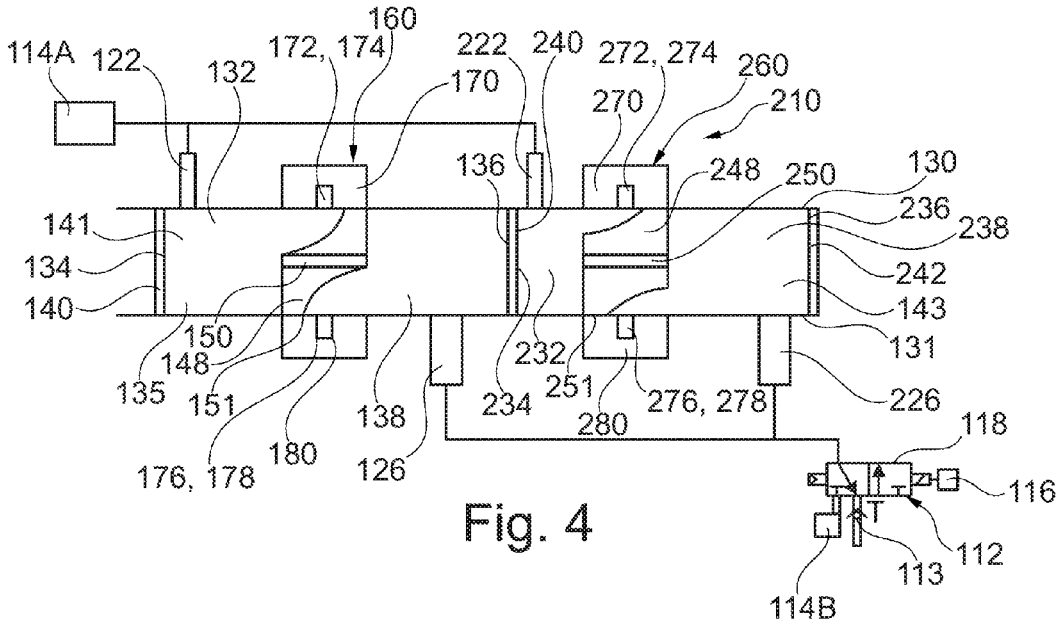
FIG. 4 is a schematic sectional view of a switchable valve train assembly including two separators.

Referring to FIG. 4, another embodiment of the switchable valve train assembly 210 is illustrated. In this embodiment, the rocker shaft 130 includes a central space 135 that is divided by an intermediate divider 240. A supply assembly 114A, 114B includes a pressurized fluid source for pressurized hydraulic fluid, and a solenoid 116 and a control valve 118 selectively supply the pressurized hydraulic fluid. Hydraulic lash adjuster feed channels 122, 222 are in fluid connection with the pressurized fluid source, and first and second switch channels 126, 226 are in fluid connection with the control valve 118. The central space 135 of the hollow rocker shaft 130 is defined by a radially inner surface 131. The intermediate divider 240 defines a first chamber 141 and a second chamber 143 in the central space 135. First and second separators 148, 248 are secured in a respective one of the first chamber 141 and the second chamber 143, and a radially outer surface 151, 251 of the first separator 148 and the second separator 248 engages the radially inner surface 131 of the rocker shaft 130. The first separator and the second separator 148, 248 each divide the first chamber 141 and the second chamber 143 into (1) a first sub-chamber 132, 232 extending between a first sub-chamber axial end 134, 234 and the respective separator 148, 248, and (2) a second sub-chamber 138, 238 extending between a second sub-chamber axial end 136, 236 and the respective separator 148, 248. The first separator 148 and the second separator 248 each include an orifice 150, 250 defined between the first sub-chamber 132, 232 and the second sub-chamber 138, 238 providing fluid connection between the first sub-chamber 132, 232 and the second sub-chamber 138, 238. A first sub-chamber end cap 140 is fixed in the rocker shaft 130 to define the first sub-chamber axial end 134, and a second sub-chamber end cap 242 is fixed in the rocker shaft 130 to define the second sub-chamber axial end 236. Each of the hydraulic lash adjuster feed channels 122, 222 are in fluid communication with a respective one of the first sub-chambers 132, 232, and each of the switch channels 126, 226 are in fluid communication with a respective one of the second sub-chambers 138, 238. First and second rocker arm assemblies 160, 260 are arranged on the rocker shaft 130 and each include a hydraulic lash adjuster 170, 270 connected to a first intake port 174, 274 and a locking assembly 180, 280 connected to a second intake port 178, 278. The first sub-chambers 132, 232 each include a first actuator port 172, 272 in fluid connection with the first intake port 174, 274 for the hydraulic lash adjuster 170, 270, and the second sub-chambers 138, 238 each include a second actuator port 176, 276 in fluid connection with the second intake port 178, 278 for the locking assembly 180, 280.

Figure 5:
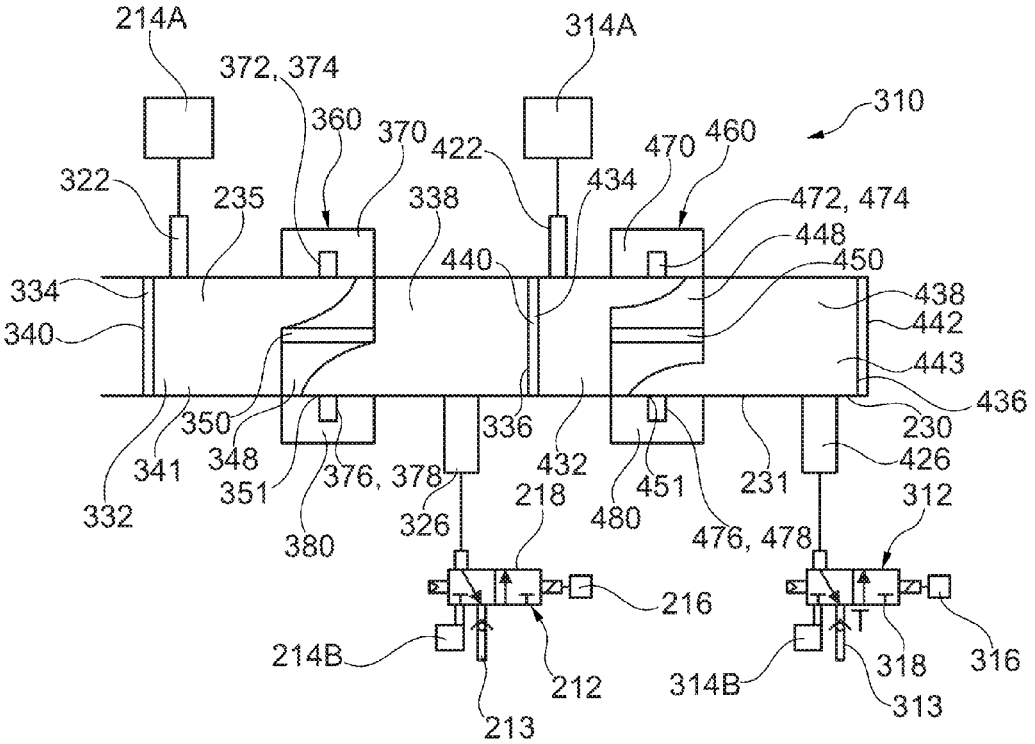
FIG. 5 is a schematic sectional view of a switchable valve train assembly including two separators and two supply assemblies.

Referring to FIG. 5, another embodiment of the switchable valve train assembly 310 is illustrated. This embodiment is similar to the embodiment illustrated in FIG. 4, except multiple supply assemblies and control valves are provided. First and second supply assemblies 214A, 214B, 314A, 314B each include a pressurized fluid source for pressurized hydraulic fluid, and a solenoid 216, 316 and a control valve 218, 318 for selectively supplying the pressurized hydraulic fluid. First and second hydraulic lash adjuster feed channels 322, 422 are in fluid connection with a respective pressurized fluid source. First and second switch channels 326, 426 are in fluid connection with a respective control valve 218, 318. The hollow rocker shaft 230 includes a central space 235 defined by a radially inner surface 231. An intermediate divider 440 defines a first chamber 341 and a second chamber 443 in the central space 235. First and second separators 348, 448 are secured in a respective one of the first chamber 341 and the second chamber 443, and a radially outer surface 351, 451 of the first separator 348 and the second separator 448 engages the radially inner surface 231 of the rocker shaft 230. The first separator and the second separator 348, 448 each divide the first chamber 341 and the second chamber 443 into (1) a first sub-chamber 332, 432 extending between a first sub-chamber axial end 334, 434 and the respective separator 348, 448, and (2) a second sub-chamber 338, 438 extending between a second sub-chamber axial end 336, 436 and the respective separator 348, 448, the first separator 348 and the second separator 448 each including an orifice 350, 450 defined between the first sub-chamber 332, 432 and the second sub-chamber 338, 438 providing fluid connection between the first sub-chamber 332, 432 and the second sub-chamber 338, 438. A first sub-chamber end cap 340 is fixed in the rocker shaft 230 to define the first sub-chamber axial end 334, and a second sub-chamber end cap 442 is fixed in the rocker shaft 230 to define the second sub-chamber axial end 436. Each of the hydraulic lash adjuster feed channels 322, 422 are in fluid communication with a respective one of the first sub-chambers 332, 432, and each of the switch channels 326, 426 is in fluid communication with a respective one of the second sub-chambers 338, 438. First and second rocker arm assemblies 360, 460 are arranged on the rocker shaft 230 and each include a hydraulic lash adjuster 370, 470 connected to a first intake port 374, 474 and a locking assembly 380, 480 connected to a second intake port 378, 478. The first sub-chambers 332, 432 each include a first actuator port 372, 472 in fluid connection with the first intake port 374, 474 for the hydraulic lash adjuster 370, 470, and the second sub-chambers 338, 438 each include a second actuator port 376, 476 in fluid connection with the second intake port 378, 478 for the locking assembly 380, 480.

The embodiments shown in FIGS. 4 and 5 illustrate the control valves in a single position, however one of ordinary skill in the art would recognize that the control valves can be actuated to change positions as discussed above with respect to FIGS. 2 and 3. Although only two separators are shown in FIGS. 4 and 5, one of ordinary skill in the art would recognize from the present disclosure that more than two separators could be provided using the same design and configuration shown in FIGS. 4 and 5.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LIST OF REFERENCES switchable valve train assembly 10
supply assembly 12
check valve 13
pressurized fluid source 14A, 14B
solenoid 16
control valve 18
hydraulic lash adjuster feed channel 22
switch channel 26
rocker shaft 30
radially inner surface 31
first chamber 32
central opening 33
first chamber axial end 34
second chamber axial end 36
second chamber 38
first chamber end cap 40
second chamber end cap 42
first sleeve 44
second sleeve 46
separator 48
orifice 50
radially outer surface 51
first recess 53
second recess 55
first axially extending flange 56
first passage 57
second axially extending flange 58
second passage 59
rocker arm assembly 60
first bolt 62
second bolt 64
radially inner surface 66
radially inner surface 68
hydraulic lash adjuster 70
first actuator port 72
first intake port 74
second actuator port 76
second intake port 78
locking assembly 80
switchable valve train assembly 100
rocker shaft 101
hollow center 104
camshaft end 106
valve end 108
plurality of rocker arm assemblies 110

What is claimed is:

1. A switchable valve train assembly comprising:

a supply assembly including a pressurized fluid source for pressurized hydraulic fluid, and a solenoid and a control valve for selectively supplying the pressurized hydraulic fluid;

a hydraulic lash adjuster feed channel in fluid connection with the pressurized fluid source;

a switch channel in fluid connection with the control valve;

a hollow rocker shaft including a central space with one or more chambers defined by a radially inner surface;

a separator secured in the central space of the rocker shaft and a radially outer surface of the separator engages the radially inner surface of the rocker shaft, the separator dividing the central space of the rocker shaft into (1) a first chamber extending between a first chamber axial end and the separator, and (2) a second chamber extending between a second chamber axial end and the separator, the separator including an orifice defined between the first chamber and the second chamber providing fluid connection between the first chamber and the second chamber, a first chamber end cap fixed in the rocker shaft defining the first chamber axial end, and a second chamber end cap fixed in the rocker shaft defining the second chamber axial end;

wherein the hydraulic lash adjuster feed channel is in fluid communication with the first chamber;

wherein the switch channel is in fluid communication with the second chamber; and a rocker arm assembly arranged on the rocker shaft includes a hydraulic lash adjuster connected to a first intake port and a locking assembly connected to a second intake port, the first chamber includes a first actuator port in fluid connection with the first intake port for the hydraulic lash adjuster, and the second chamber includes a second actuator port in fluid connection with the second intake port for the locking assembly.

2. The switchable valve train assembly of claim 1, wherein the separator is press-fit within the rocker shaft.

3. The switchable valve train assembly of claim 1, wherein the first chamber end cap and the second chamber end cap are press-fit within the rocker shaft.

4. The switchable valve train assembly of claim 1, wherein the separator is formed from plastic.

5. The switchable valve train assembly of claim 1, wherein the separator is formed from metal.

6. The switchable valve train assembly of claim 1, wherein the separator includes a first recess on the radially outer surface that defines a first passage between the first chamber and the first actuator port, and the separator includes a second recess on the radially outer surface that defines a second passage between the second chamber and the second actuator port.

7. The switchable valve train assembly of claim 6, wherein the first recess and the second recess overlap in a radially extending plane.

8. The switchable valve train assembly of claim 1, wherein (1) the supply assembly has a first state in which the control valve closes a flow path from the pressurized fluid source to the switch channel, and the orifice allows pressurized hydraulic fluid to flow from the first chamber to the second chamber, and the second chamber directs pressurized hydraulic fluid to the switch channel, and (2) the supply assembly has a second state in which the solenoid is activated and the control valve opens the flow path from the pressurized fluid source to the switch channel such that pressurized hydraulic fluid is provided via the switch channel to the locking assembly via the second chamber.

9. A rocker shaft for a switchable valve train, the rocker shaft comprising:

a hollow rocker shaft including a central opening defined by a radially inner surface;

a separator secured in the central opening of the rocker shaft and a radially outer surface of the separator engages the radially inner surface of the rocker shaft, the separator dividing the central opening of the rocker shaft into (1) a first chamber extending between a first chamber axial end and the separator, and (2) a second chamber extending between a second chamber axial end and the separator, the separator including an orifice defined between the first chamber and the second chamber providing fluid connection between the first chamber and the second chamber, a first chamber end cap fixed in the rocker shaft defining the first chamber axial end, and a second chamber end cap fixed in the rocker shaft defining the second chamber axial end.

10. The rocker shaft of claim 9, wherein the separator is press-fit within the rocker shaft.

11. The rocker shaft of claim 9, wherein the first chamber end cap and the second chamber end cap are press-fit within the rocker shaft.

12. The rocker shaft of claim 9, wherein the separator is formed from plastic.

13. The rocker shaft of claim 9, wherein the separator is formed from metal.

14. The rocker shaft of claim 9, wherein the separator includes a first recess on the radially outer surface that defines a first passage between the first chamber and a first actuator port, and the separator includes a second recess on the radially outer surface that defines a second passage between the second chamber and a second actuator port.

15. The rocker shaft of claim 14, wherein the first recess and the second recess overlap in a radially extending plane.

16. A switchable valve train assembly comprising:

first and second supply assemblies each including a pressurized fluid source for pressurized hydraulic fluid, and each including a solenoid and a control valve for selectively supplying the pressurized hydraulic fluid;

first and second hydraulic lash adjuster feed channels in fluid connection with a respective pressurized fluid source;

first and second switch channels in fluid connection with a respective control valve;

a hollow rocker shaft including a central space defined by a radially inner surface;

an intermediate divider defining a first chamber and a second chamber in the central space;

first and second separators secured in a respective one of the first chamber and the second chamber, and a radially outer surface of the first separator and the second separator engages the radially inner surface of the rocker shaft, the first separator and the second separator each dividing the first chamber and the second chamber into (1) a first sub-chamber extending between a first sub-chamber axial end and the respective separator, and (2) a second sub-chamber extending between a second sub-chamber axial end and the respective separator, the first separator and the second separator each including an orifice defined between the first sub-chamber and the second sub-chamber providing fluid connection between the first sub-chamber and the second sub-chamber, a first sub-chamber end cap fixed in the rocker shaft defining the first sub-chamber axial end, and a second sub-chamber end cap fixed in the rocker shaft defining the second sub-chamber axial end;

wherein each of the hydraulic lash adjuster feed channels are in fluid communication with a respective one of the first sub-chambers, and each of the switch channels are in fluid communication with a respective one of the second sub-chambers; and first and second rocker arm assemblies arranged on the rocker shaft each including a hydraulic lash adjuster connected to a first intake port and a locking assembly connected to a second intake port, the first sub-chambers each include a first actuator port in fluid connection with the first intake port for the hydraulic lash adjuster, and the second sub-chambers each include a second actuator port in fluid connection with the second intake port for the locking assembly.

17. The switchable valve train assembly of claim 16, wherein the first separator, the second separator, and the intermediate divider are press-fit within the rocker shaft.

18. The switchable valve train assembly of claim 16, wherein the first separator and the second separator are identical.

* * * * *